US006325252B1

(12) United States Patent
Brozell et al.

(10) Patent No.: US 6,325,252 B1
(45) Date of Patent: Dec. 4, 2001

(54) CLOSURE DISPENSING ENGINE WITH ATTACHED OUTER DECOATIVE SHELL

(75) Inventors: Leonora M. Brozell, Toledo; Richard D. Lohrman, Sylvania, both of OH (US)

(73) Assignee: Owens-Illinois Closure Inc., Toledo, OH (US)

( * ) Notice: Subject to any disclaimer, the term of this patent is extended or adjusted under 35 U.S.C. 154(b) by 0 days.

(21) Appl. No.: 09/552,551

(22) Filed: Apr. 19, 2000

(51) Int. Cl.[7] ..... B67D 3/00
(52) U.S. Cl. ..... 222/212; 222/536; 222/556
(58) Field of Search ..... 222/212, 534, 222/536, 556

(56) References Cited

U.S. PATENT DOCUMENTS

| | | |
|---|---|---|
| 4,257,539 | 3/1981 | Cary et al. . |
| 4,513,890 | 4/1985 | Goncalves . |
| 5,105,989 | 4/1992 | Gutkowski . |
| 5,123,561 | 6/1992 | Gross . |
| 5,201,440 | 4/1993 | Gross . |
| 5,213,235 | 5/1993 | Miranda . |
| 5,234,132 | 8/1993 | Bachand et al. . |
| 5,482,172 | 1/1996 | Braddock . |
| 5,503,309 | 4/1996 | Oder et al. . |
| 5,622,284 | 4/1997 | Sawicki . |
| 5,649,645 | 7/1997 | Demarest et al. . |
| 5,779,101 | 7/1998 | Holmgren et al. . |
| 5,862,963 | 1/1999 | Fuchs et al. . |
| 5,890,632 | 4/1999 | Chalupsky et al. . |
| 5,918,777 | 7/1999 | Flak . |

FOREIGN PATENT DOCUMENTS

| | | |
|---|---|---|
| 0791542 | 8/1997 | (EP) . |

*Primary Examiner*—Kenneth Bomberg

(57) ABSTRACT

A dispensing package that includes a container having a body with a shoulder of predetermined peripheral contour and a dispensing closure assembly secured to the finish container. The dispensing closure assembly includes a dispensing engine having a base secured to the container finish and a valve element mounted to the base for opening and closing a dispensing opening in the engine base. A shell has an upper surface with a pocket within which the base of the dispensing engine is mounted so that the valve element is flush with the upper surface of the shell in the closed position of the valve element. The shell pocket has a base wall against which the engine base rests, and the engine base extends through an opening in the shell base wall for securement to the container finish. The shell is firmly captured between the dispensing engine and the container shoulder. The shell has an outer peripheral wall that depends from the upper surface to adjacent the shoulder of the container. The shell is firmly captured between the dispensing engine and the container shoulder. The shell peripheral wall has a contour matching the peripheral contour of the container shoulder, such that the peripheral wall is flush and blends with the container sidewall and shoulder. The dispensing engine may be employed in conjunction with shells having differing peripheral wall configurations, so that a single dispensing engine can be used in conjunction with plural container configurations.

34 Claims, 5 Drawing Sheets

CLOSURE DISPENSING ENGINE WITH ATTACHED OUTER DECOATIVE SHELL

The present invention is directed to dispensing closures of the type having a valve element movable from a closed position to an open position for dispensing product, and more particularly to attachment of an outer decorative shell to a closure dispensing engine for matching the contour of a container on which the dispensing engine is to be mounted.

BACKGROUND AND SUMMARY OF THE INVENTION

Dispensing closures of the type contemplated in accordance with the present invention comprise a base for securement to the finish of a container and a valve element mounted on the base. The base has a dispensing opening, and the valve element is movable between a closed position that closes the dispensing opening and an open position for dispensing product through the dispensing opening. Dispensing closures of this type include snap-hinge closures of the type illustrated in U.S. Pat. No. 5,489,035, flexible valve closures of the type illustrated in U.S. Pat. No. 5,927,567, pivotal actuator closures of the type illustrated in U.S. Pat. No. 5,862,963, turret-type dispensing closures and push/pull dispensing closures. When employing dispensing closures of this character, the closure typically closely surrounds the container finish and extends axially from an end surface of the container formed by the container shoulder.

It is a general object of the present invention to provide a dispensing closure assembly that includes a dispensing closure engine mounted within a decorative shell that can be closely matched to the contour of the container on which the assembly is to be mounted. A more specific object of the invention is to provide an assembly of the described character in which the closure dispensing engine can be used in conjunction with a plurality of differing shell constructions, so that a single dispensing engine construction can be used in conjunction with shell contours desired by differing customers and/or in conjunction with the changing shell requirements of a specific customer needed to provide a closure assembly and container package having a look desired by the customer. Further objects of the present invention are to provide a dispensing closure assembly of the described character that requires simplified a mold geometry for the manufacturing process, that is easy to assemble and can be readily accommodated by automatic assembly equipment, for which automated assembly equipment can be rapidly modified to accommodate differing shell configurations, and/or in which the dispensing engine is secured to the shell without gaps or spaces between the engine and the shell.

In accordance with one aspect of the present invention, there is provided a dispensing package that includes a container having a body with a shoulder of predetermined peripheral contour and a dispensing closure assembly secured to the container. The dispensing closure assembly includes a dispensing engine having a base secured to the container finish and a valve element mounted to the base for opening and closing a dispensing opening in the engine base. A shell has an upper surface with a pocket within which the base of the dispensing engine is mounted so that the valve element is flush with the upper surface of the shell in the closed position of the valve element. The shell pocket has a base wall against which the engine base rests, and the engine base extends through an opening in the shell base wall for securement to the container finish. The shell has an outer peripheral wall that depends from the upper surface to adjacent the shoulder of the container. The shell is thus firmly captured between the dispensing engine and the container, and will not separate from the container if the package is dropped, for example. The shell peripheral wall has a contour matching the peripheral contour of the container shoulder, such that the peripheral wall is flush and blends with the container sidewall and shoulder. The dispensing engine may be employed in conjunction with shells having differing peripheral wall configurations, so that a single dispensing engine can be used in conjunction with plural container configurations.

A dispensing closure assembly in accordance with another aspect of the present invention includes a dispensing engine having a base with a dispensing opening and facility for attachment to a container finish, and a valve element mounted on the base for selectively opening and closing the dispensing opening. A shell has an outer peripheral wall and a recessed pocket with a base wall against which the base of the dispensing engine rests when the shell is secured to the base. The base wall of the shell pocket has an opening through which the engine base extends for securement to the container finish. The base of the dispensing engine and the shell have interlocking elements for securing the dispensing engine within the recessed pocket of the shell, such that the dispensing engine is adapted for assembly with shell having differing peripheral wall configurations.

A method making a dispensing closure assembly in accordance with a third aspect of the present invention includes the step of providing a dispensing engine having a base with a dispensing opening and facility for attachment to a container finish, and a valve element mounted on the base. A shell is provided having a peripheral wall and a recessed pocket, and the dispensing engine is secured to the shell within the pocket. The base of the engine extends through an opening in the base wall for securement to a container finish. In the preferred method of the invention, a container is provided having a body, a shoulder of predetermined peripheral contour, and a finish extending from the shoulder, and the base of the dispensing closure assembly is secured to the finish of the container. The shell has an upper surface with which the dispensing engine actuator is flush in the closed position of the actuator, and the peripheral wall of the shell is contoured to be adjacent to and flush with the shoulder and sidewall of the container.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF THE PREFERRED EMBODIMENTS

Figure 1:
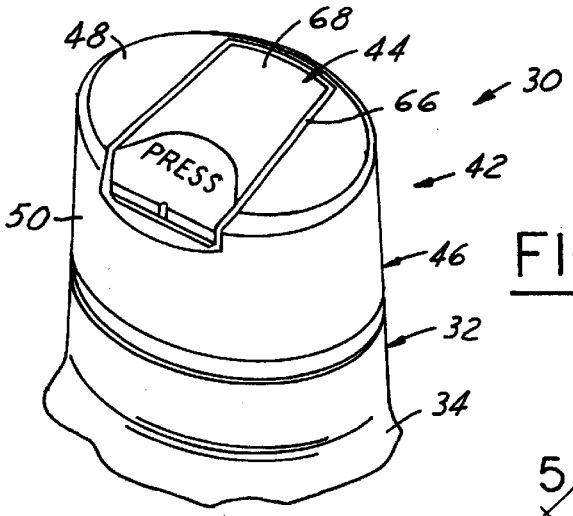
FIG. 1 is a fragmentary perspective view of a closure and container package in accordance with one presently preferred embodiment of the invention.
Figure 2:
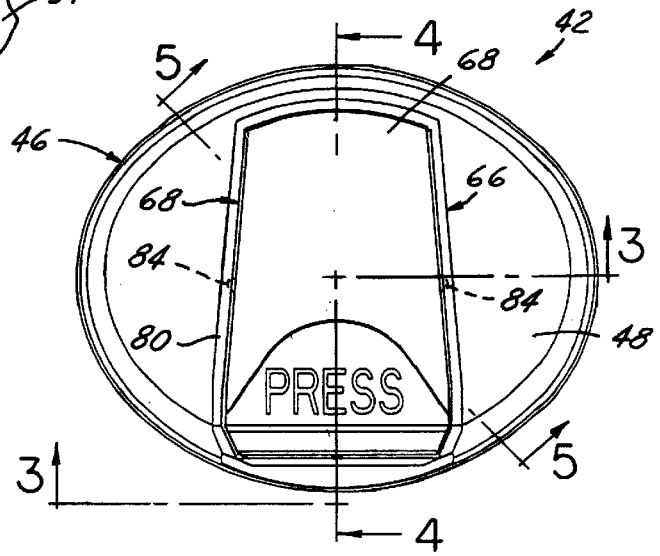
FIG. 2 is a top plan view of the package illustrated in FIG. 1.

FIGS. 1–14 and 21 illustrate a dispensing closure and container package 30 in accordance with one presently preferred embodiment of the invention. Package 30 includes a container 32 of molded plastic, for example, having a sidewall 34 that terminates in a shoulder 36 from which a generally cylindrical finish 38 axially extends. Container sidewall 34 and shoulder 36 may be of any desired contour, such as an oval contour in the embodiment illustrated in FIGS. 1–5. A bead 40 extends circumferentially around the external surface of finish 38 in a plane perpendicular to the axis of the finish for securement of a dispensing closure assembly 42. Container 32 may be of any suitable construction, preferably blow molded plastic construction. Container 32 is illustrated as being of oval cross section, but may be of any desired cross sectional contour.

Figure 4:
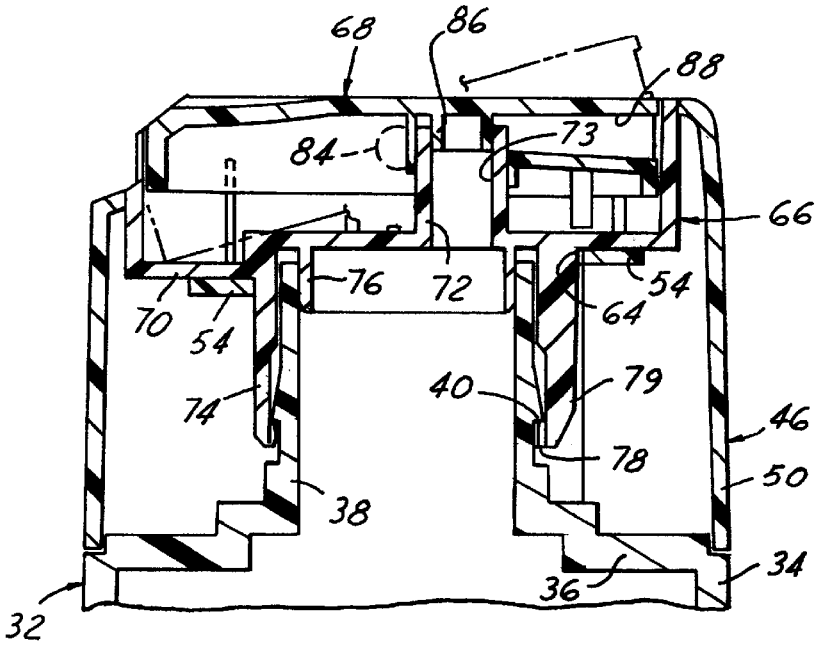
Figure 5:
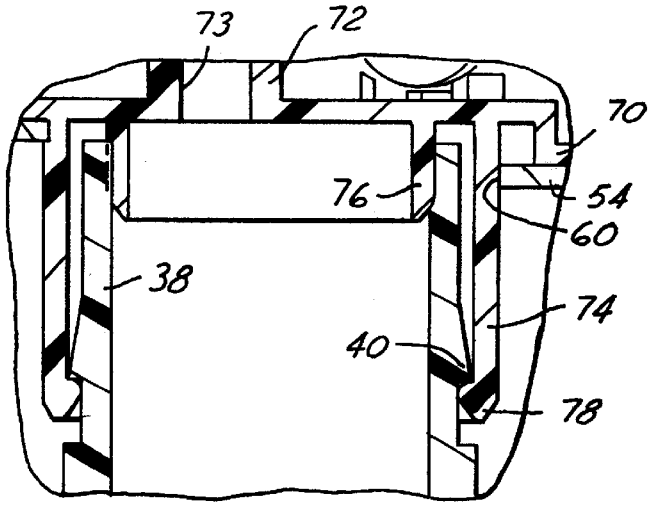
Figure 7:
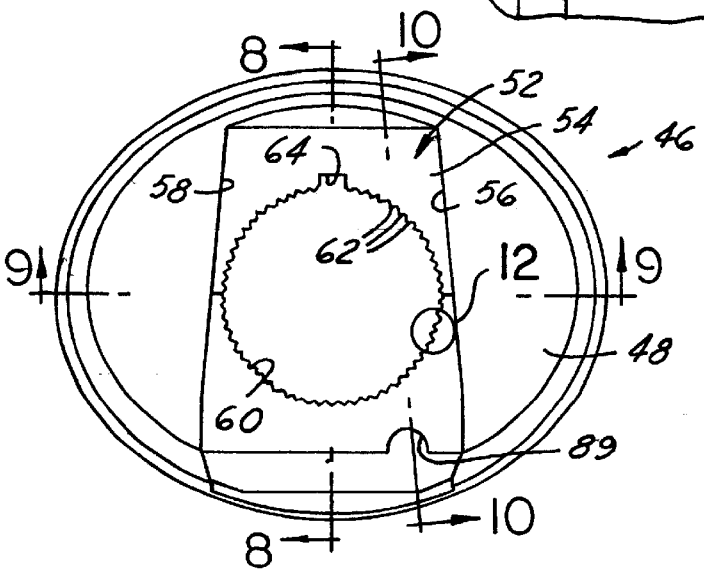
FIG. 7 is a top plan view of the decorative shell in the dispensing closure assembly illustrated in FIGS. 1–5.
Figure 8:
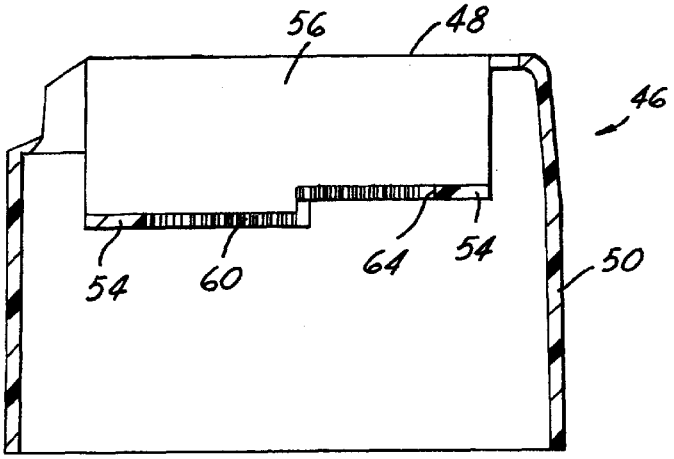
FIGS. 8, 9 and 10 are sectional views taken substantially along the respective lines 8—8, 9—9 and 10—10 in FIG. 7.
Figure 11:
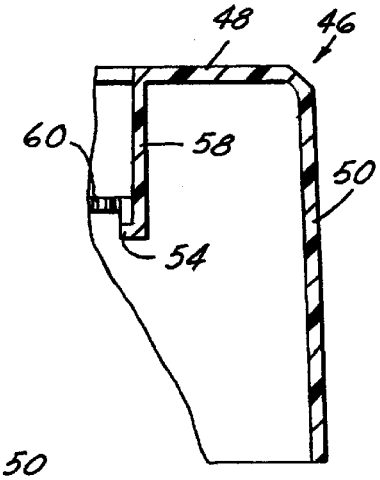
FIG. 11 is a fragmentary sectional view taken substantially along the line 11—11 in FIG. 10.
Figure 9:
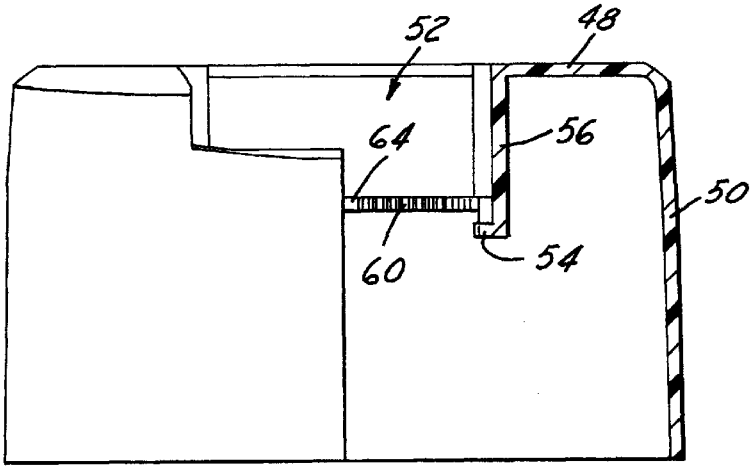
Figure 12:
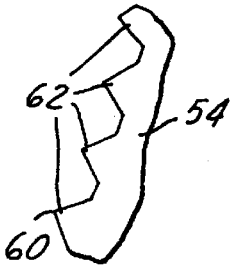
FIG. 12 is a fragmentary view on an enlarged scale of the portion of FIG. 7 within the circle 12.
Figure 10:
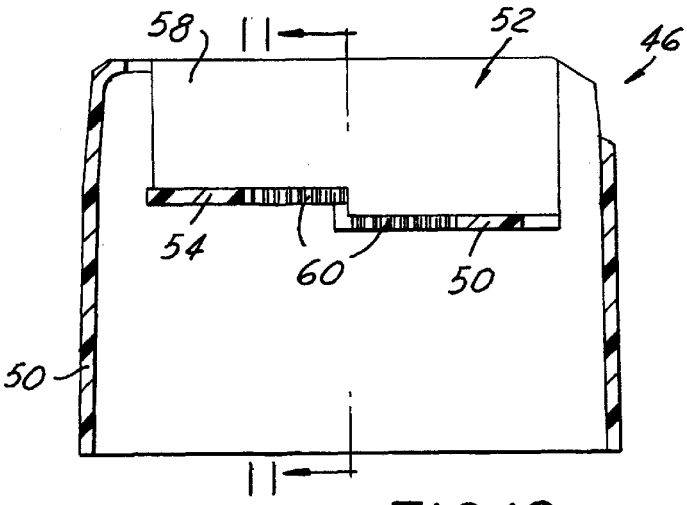
Figure 13:
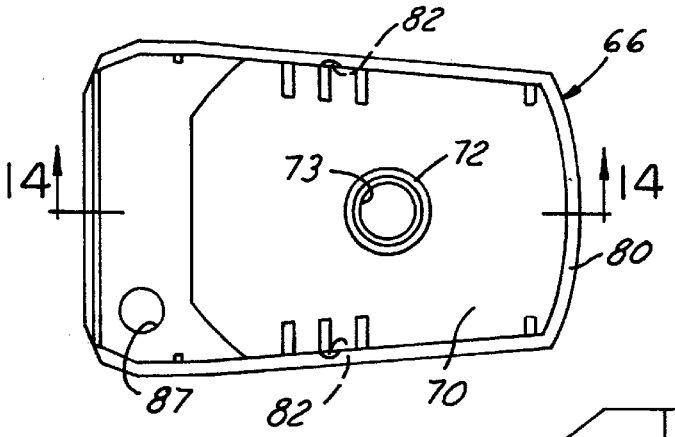
FIG. 13 is a top plan view of the base of the dispensing engine in the embodiment of FIGS. 1–5.

Dispensing closure assembly 42 includes a dispensing closure engine 44 and a decorative shell 46 to which engine 44 is mounted. Shell 46 has a flat top wall 48 from which an outer peripheral wall or skirt 50 depends. A central pocket 52 in top wall 48 has a base wall 54 that is suspended from top wall 48 by two integral sidewalls 56, 58. Sidewalls 56, 58 are laterally angulated toward each other, as best seen in FIG. 7. Base wall 54 is formed of two axially displaced base wall sections, as best seen in FIGS. 4, 8 and 10. An opening 60 is centrally formed in base wall 54, and has a periphery defined by a multiplicity of serrations or teeth 62. A generally rectangular notch 64 (FIGS. 7 and 8) extends radially outwardly from opening 60, interrupting the peripheral serrations 62 that surround opening 60, at the mid position of the opening between pocket sidewalls 56, 58, and at the side of the shell at which sidewalls 56, 58 are closest to each other. The opposed ends of base wall 54 between sidewalls 56, 58 terminate short of shell peripheral wall, as best seen in FIGS. 7–8 and 10.

Dispensing engine 44 in the illustrated embodiment of the invention comprises a base 66 and a toggle or actuator 68. Base 66 (FIGS. 3–5 and 13–14) is of one-piece molded plastic construction, and includes a stepped base wall 70 that matches the stepped construction of pocket base wall 54 in shell 46. An annular wall 72 extends from base wall 70 and defines a dispensing opening 73 for dispensing product from within package 30. An outer annular collar 74 depends from base wall 70 surrounding the dispensing opening, and an inner annular collar 76 is coaxial with but spaced radially inwardly from outer collar 74. Outer collar 74 has a circumferentially segmented internal bead 78 that is received in assembly by snap fit over bead 48 on container finish 38 for securing dispensing closure assembly 42 to container 32. A rectangular rib 79 extends axially along the outer surface of collar 74. A peripheral wall 80 projects upwardly from base wall 70. A pair of laterally aligned pockets 82 are formed on the internal surface of peripheral wall 80 for receiving part-spherical outwardly extending and laterally aligned embossments 84 (FIG. 3) on actuator 44. Actuator 44 has an annular collar 86 for plug-sealing engagement with wall 72 on base 68 in the closed position of the actuator (FIG. 4), and has a lateral internal passage 88 for dispensing product from the package in the open position of the actuator. The upper portion of base 66 and the cooperative relationship with actuator 68 are generally as disclosed in U.S. Pat. No. 5,862,963, the disclosure of which is incorporated herein by reference. A drain opening 87 (FIG. 13) aligns with a notch 89 (FIG. 7) to allow drainage of any liquid that may collect in pocket 52, such as the dispensing package used for body lotion in a shower.

Figure 3:
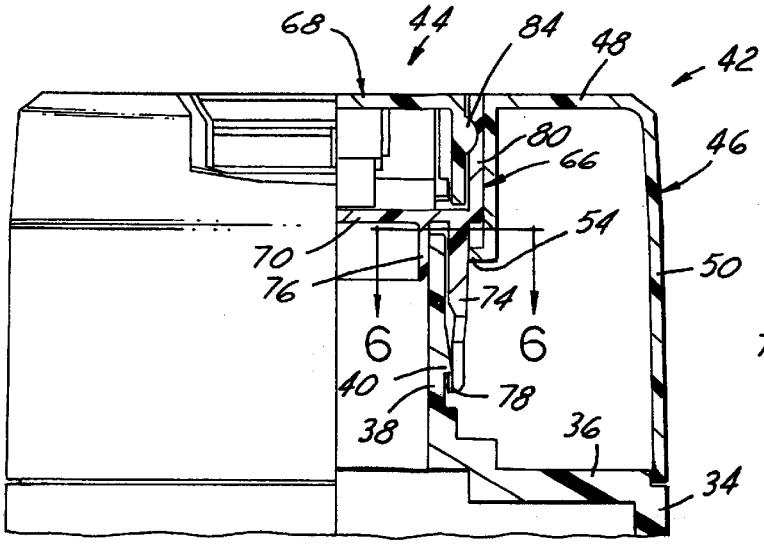
FIGS. 3, 4 and 5 are sectional views taken substantially along the respective lines 3—3, 4—4 and 5—5 in FIG. 2.
Figure 6:
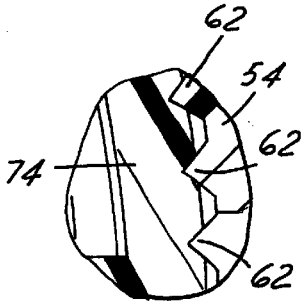
FIG. 6 is a fragmentary sectional view taken substantially along the line 6—6 in FIG. 3.
Figure 14:
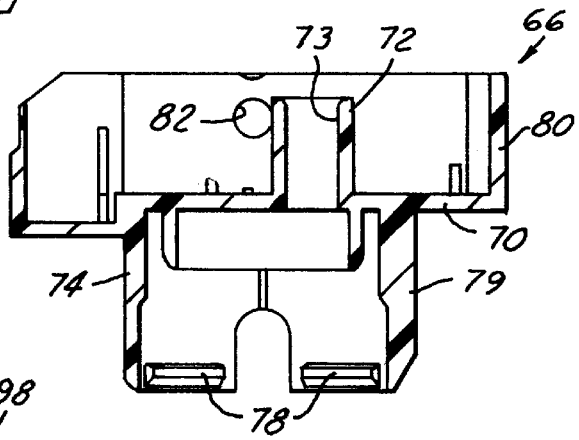
FIG. 14 is a sectional view taken substantially along the line 14—14 in FIG. 13.

As noted above, actuator 68, base 66, shell 46 and container 32 preferably are each of integrally molded plastic construction. Actuator 68 is assembled to base 66 by snapping the actuator into the base to form dispensing engine 44. Dispensing engine 44 is then secured to shell 42 by aligning collar 74 of base 66 with opening 60 in base wall 48 of shell 42. Collar 74 is then press fitted into opening 60, with serrations 62 slidably engaging the external surface of collar 74. Base 66 of engine 44 is automatically aligned with pocket 52 of shell 46 by reason of sliding disposition of external rib 79 on collar 74 with notch 64 in base wall 46. Additionally, engine 44 is automatically aligned with pocket 52 by reason of the non-circular geometry of the engine periphery and the pocket. Serrations 62 engage and dig into the external surface of collar 74, as best seen in FIG. 6, resisting removal of engine 44 from shell 42. When the dispensing engine is fully inserted into the shell pocket, the upper surface of toggle or actuator 68 is flush with the upper surface of shell wall 48 in the closed position of the actuator. The dispensing closure assembly 42 is then assembled to container 32 by pressing collar 74 over container finish 38 until segmented bead 78 on collar 74 snap over bead 40 on finish 38. As best seen in FIG. 14, collar 78 is partially segmented to allow segmented bead 78 to expand circumferentially for snap fit over container finish bead 40. In this fully assembled position of dispensing closure assembly 42, the lower edge of shell peripheral wall 50 is positioned closely adjacent to the outer edge of shoulder 36, as best seen in FIGS. 3 and 4. Shell peripheral wall 50 in the embodiment of FIGS. 1–14 and 21 is of oval contour, matching the oval contour of shoulder 36 and sidewall 34 adjacent to the shoulder. However, dispensing engine 44 can as readily be used in conjunction with shells having a different peripheral wall contour matching the contour of other container configurations. Thus, for example, if a customer desires a new container look, container 32 and shell 46 can be retooled, but the same dispensing engine 44 can be employed, thus not necessitating the expense of new dispensing engine tooling.

Figure 15:
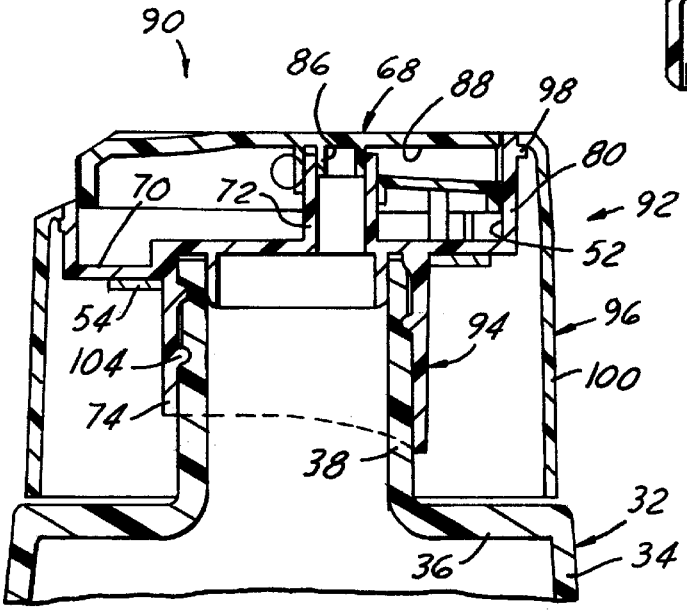
FIG. 15 is a fragmentary sectional view similar to that of FIG. 4 but showing a modified dispensing closure and container package in accordance with the invention.

FIG. 15 illustrates a package 90 that comprises container 32 in combination with a dispensing closure assembly 92 of slightly different configuration. In this embodiment, base 94 is secured to shell 96 by reason of a rib or bead 98 that extends at least part-way around peripheral wall 80 of base 94. This bead or rib 98 is received by snap fit beneath the upper edge of pocket 52 in base 94. That is, bead 98 is received beneath top wall 48 of shell 46 at the laterally spaced ends of pocket 52, but not at the sides of pocket 52 where walls 56, 58 suspend base wall 54 from top wall 48. Shell peripheral wall 100 again depends downwardly to a position adjacent to container shoulder 36 and sidewall 34. In this embodiment, there is at least one external thread 92 on container finish 38, which cooperates with an internal thread 104 on collar 74 of base 94. Thus, in this embodiment, dispensing closure assembly 92 is secured by mating threads to finish 38 of container 32.

Figure 16:
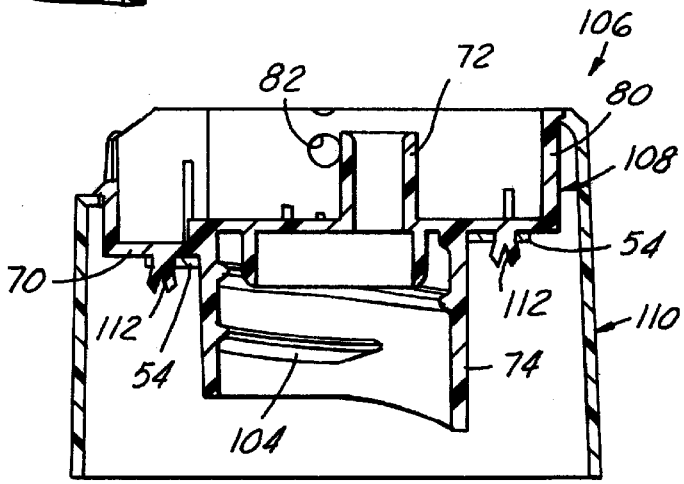
FIG. 16 is a fragmentary sectional view of a dispensing closure assembly (minus actuator) in accordance with a further embodiment of the invention.
Figure 17:
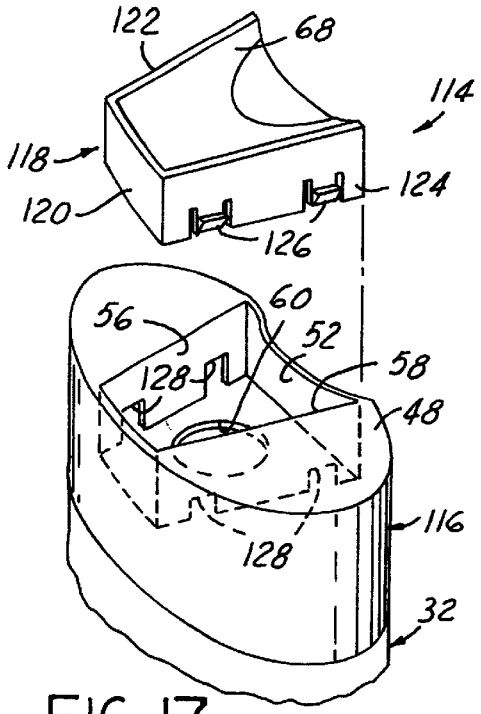
FIG. 17 is an exploded perspective view of a dispensing closure assembly in accordance with yet another embodiment of the invention.
Figure 18:
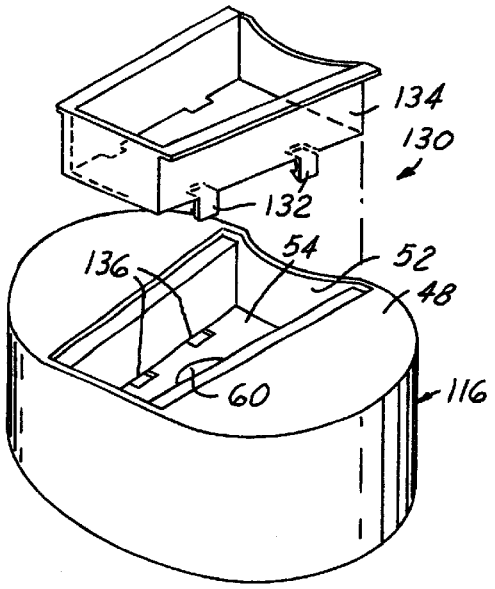
FIG. 18 is an exploded perspective view of a dispensing closure assembly in accordance with a further embodiment of the invention (again minus the actuator)
Figure 19:
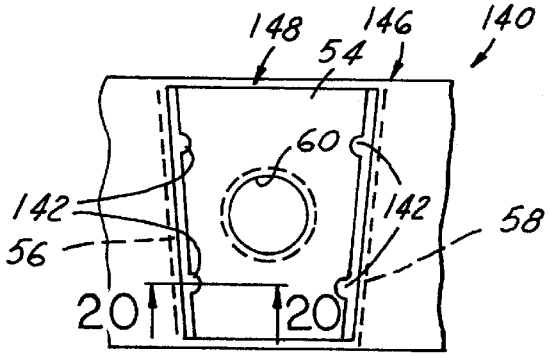
FIG. 19 is atop plan view of a dispensing closure shell in accordance with another embodiment of the invention.
Figure 20:
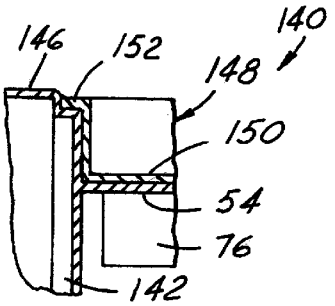
FIG. 20 is a fragmentary section view taken substantially along the line 20—20 in FIG. 19 but showing the dispensing engine secured within the shell.
Figure 21:
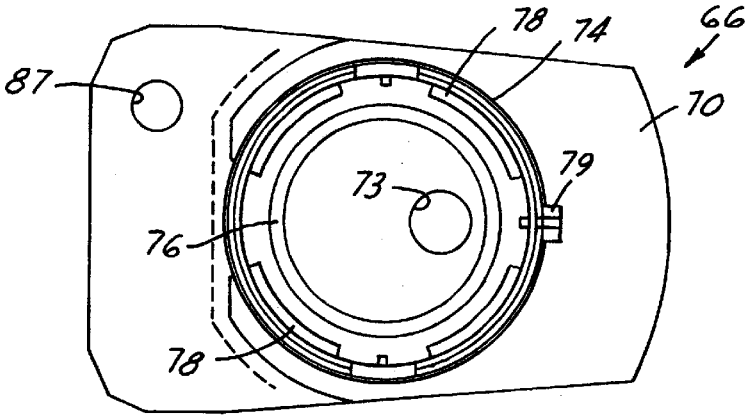
FIG. 21 is a bottom plan view of the base illustrated in FIGS. 13 and 14.

FIG. 16 illustrates a dispensing closure assembly 106, in which base 108 of the dispensing engine is secured to base wall 48 of shell 110 by means of a pair of resilient split plugs 112 that integrally extend downwardly from wall 70 and are received by snap fit through a pair of openings in shell base wall 48. Actuator 68 is not illustrated in FIG. 16. FIG. 17 illustrates a dispensing closure assembly 114 that includes a shell 116 and a dispensing engine 118. Dispensing engine 118 has a base 120 with angulated sidewalls 122, 124. Each sidewall 122, 124 includes a pair of laterally outwardly projecting resilient lugs 126. In pocket 52 of shell 16, there are a pair of spaced openings 128 formed in each sidewall 56, 58. Lugs 126 are received by snap fit within openings 128 when dispensing engine 118 is inserted into pocket 52 of shell 116 to retain the dispensing engine within the shell. The dispensing engine 130 illustrated in FIG. 18 is similar to that of FIG. 17, except that the resilient spring lugs 132 on dispensing engine base 134 project axially and then laterally inwardly, and the lug-receiving pockets 136 are formed along the outer edges of base wall 54 of engine-receiving shell pocket 52. FIGS. 19 and 20 fragmentarily illustrate a dispensing closure assembly 140. A pair of laterally spaced axial ribs 142 extend along each sidewall 56, 58 that define pocket 54 in shell 146. Base 150 of dispensing engine 148 has opposed lateral flanges 152 that cover the upper ends of ribs 142 in assembly. Engagement of base 150 with ribs 142, rather than sidewalls 56, 58, reduces axial insertion force.

There have thus been disclosed a dispensing closure assembly and container package, a dispensing closure assembly, and a method of forming a dispensing closure assembly, which fully satisfy all of the objects and aims previously set forth. A dispensing engine of given design can be used in combination with a shell of any desired decorative contour. The dispensing engine maybe readily assembled to the shell employing standard automated assembly equipment, and the equipment can be readily modified for use in conjunction with shells of differing configurations. The assembly of the dispensing engine to the shell is fully secure in the sense that the dispensing engine will not become disassembled from the shell during normal use by an operator. The dispensing engine is fully integrated with the shell and with the dispensing package. A number of modifications and variations have been disclosed. In addition, as previously noted, the dispensing engine may comprise a push/pull valve, a turret-type valve, a flexible valve closure or a snap-hinge closure, instead of the toggle actuator closure that has been illustrated. Other modifications and variations will readily suggest themselves to persons of ordinary skill in the art. The invention is intended to embrace all such modifications and variations as fall within the spirit and broad scope of the appended claims.

What is claimed is:

1. A dispensing closure assembly that comprises:

a dispensing engine including a base with a dispensing opening and means for attachment to a container finish, and a valve element mounted on said base for selective movement with respect to said opening between an open portion to dispense product from the container and a closed portion closing said dispensing opening, and a shell having an outer peripheral wall and a recessed pocket through which said engine is assembled to said shell, said shell pocket having a base wall against which said base of said dispensing engine rests and an opening through which said base extends for securement to the container finish, said base and said shell having interlocking means securing said dispensing engine within said recessed pocket against said base wall of said shell, such that said dispensing engine is adapted for assembly with shells having differing configurations of said shell outer peripheral wall.

2. The assembly set forth in claim 1 wherein said interlocking means on said base and said shell comprises an axially extending collar on said base received by press fit into said opening in said base wall.

3. The assembly set forth in claim 2 wherein further comprising a circumferential array of serrations surrounding said opening in said base wall of said shell for receiving said collar by interference press fit.

4. The assembly set forth in claim 2 further comprising means for circumferentially aligning said base with said shell during press fit insertion of said base into said shell.

5. The assembly set forth in claim 4 wherein said aligning means comprises an axial rib in an outer surface of said collar and a notch in said base wall opening for receiving said rib.

6. The assembly set forth in claim 1 wherein said base has a peripheral wall, and wherein said interlocking means on said base and said shell comprise an external bead on said peripheral wall received by snap fit within said pocket of said shell.

7. The assembly set forth in claim 1 wherein said interlocking means on said base and said shell comprise openings in said pocket of said shell and lugs on said base received by snap fit in said openings.

8. The assembly set forth in claim 7 wherein said openings are in said base wall of said pocket.

9. The assembly set forth in claim 7 wherein said openings are in sidewalls of said pocket.

10. The assembly set forth in claim 1 wherein said means on said base for attachment to a container finish comprises a collar on said base and an internal thread on said collar.

11. The assembly set forth in claim 1 wherein said means on said base for attachment to a container finish comprises a collar on said base and an internal bead on said collar.

12. The assembly set forth in claim 1 further comprising means for automatically aligning said base and said shell during assembly of said base to said shell.

13. The assembly set forth in claim 12 wherein said automatic alignment means comprise complementary non-circular geometries of said base and said pocket.

14. The assembly set forth in claim 12 wherein said base has an annular axial collar, wherein said base wall has a circular opening for receiving said collar, and wherein said automatic alignment means comprise an axial rib on an outer surface of said collar and a notch in said base wall opening for receiving said rib.

15. The assembly set forth in claim 1 wherein said actuator, said base and said shell are of molded plastic construction.

16. A package that comprises:

a container having a body, a shoulder of predetermined peripheral contour, and a finish extending from said shoulder, and a dispensing closure assembly secured to said container, said dispensing closure comprising:

a dispensing engine including a base secured to said finish and having a dispensing opening, and a valve element mounted on said base for selective movement between a closed position closing said dispensing opening and an open position to dispense product from said opening, and a shell having an upper surface, a pocket in said upper surface with a base wall against which said base is mounted such that said actuator is flush with said upper surface in said closed position of said actuator, an opening in said base wall through which said base extends for securement to said container finish, and an outer peripheral wall extending from said upper surface to adjacent said shoulder and having a contour matching said peripheral contour of said shoulder such that said peripheral wall is flush with said container sidewall and said shoulder, said base and said shell having interlocking means securing said dispensing engine within said pocket against said base wall of said shell with said shell being captured between said base of said dispensing engine and said shoulder of said container.

17. The package set forth in claim 16 wherein said interlocking means on said base and said shell comprises an axially extending collar on said base received by press fit into said opening in said base wall.

18. The package set forth in claim 17 wherein further comprising a circumferential array of serrations surrounding said opening in said base wall of said shell for receiving said collar by interference press fit.

19. The package set forth in claim 17 further comprising means for circumferentially aligning said base with said shell during press fit insertion of said base into said shell.

20. The package set forth in claim 19 wherein said aligning means comprises an axial rib in an outer surface of said collar and a notch in said base wall opening for receiving said rib.

21. The package set forth in claim 16 wherein said base has a peripheral wall, and wherein said interlocking means on said base and said shell comprise an external bead on said peripheral wall received by snap fit within said pocket of said shell.

22. The package set forth in claim 16 wherein said interlocking means on said base and said shell comprise openings in said pocket of said shell and lugs on said base received by snap fit in said openings.

23. The package set forth in claim 22 wherein said openings are in said base wall of said pocket.

24. The package set forth in claim 22 wherein said openings are in sidewalls of said pocket.

25. The package set forth in claim 16 wherein said finish has an external thread, and wherein said base with an annular collar has an internal thread secured over said external thread.

26. The package set forth in claim 16 wherein said finish has an external bead, and wherein said base has an annular collar with an internal bead secured over said external bead.

27. The package set forth in claim 16 further comprising means for automatically aligning said base and said shell during assembly of said base to said shell.

28. The package set forth in claim 27 wherein said automatic alignment means comprise complementary non-circular geometries of said base and said pocket.

29. The package set forth in claim 27 wherein said base has an annular axial collar, wherein said base wall has a circular opening for receiving said collar, and wherein said automatic alignment means comprise an axial rib on an outer surface of said collar and a notch in said base wall opening for receiving said rib.

30. The package set forth in claim 16 wherein said container, said actuator, said base and said skirt are each of molded plastic construction.

31. A method of making a dispensing closure assembly that comprises the steps of:

(a) providing a dispensing engine having a base with a dispensing opening and means for attachment to a container finish, and a valve element mounted on said base, (b) providing a shell having a peripheral wall, a recessed pocket with a base wall and an opening in the base wall, and (c) securing said dispensing engine to said shell within said pocket with the shell base extending through the opening for securement to a container finish.

32. The method set forth in claim 31 wherein said step (a) comprises the steps of:

(a1) providing said base, (a2) providing said valve element, and (a3) assembling said valve element to said base.

33. The method set forth in claim 31 comprising the additional steps of:

(d) providing a container having a body, a shoulder of predetermined peripheral contour, and a finish extending from said shoulder, and (e) securing said base of said dispensing closure assembly to said finish of said container such that said shell is captured between said dispensing engine and said shoulder.

34. The method set forth in claim 33 wherein said step (a) is such that said shell has an upper surface from which said peripheral wall extends to adjacent said shoulder following said step (e), said peripheral wall having a contour matching said peripheral contour of said shoulder such that said peripheral wall is flush with said container sidewall and shoulder, and said valve element flush with said top surface of said shell in a closed position of said valve element.

* * * * *